United States Patent [19]

Burkard

[11] Patent Number: 5,050,322

[45] Date of Patent: Sep. 24, 1991

[54] SNOWPLOW APPARATUS

[76] Inventor: David A. Burkard, P.O. Box 263, Hillsboro, Ohio 45133

[21] Appl. No.: 470,073

[22] Filed: Jan. 25, 1990

[51] Int. Cl.[5] ..... E01H 5/04

[52] U.S. Cl. ..... 37/270; 37/268; 37/266

[58] Field of Search ..... 37/231, 266, 268, 270

[56] References Cited

U.S. PATENT DOCUMENTS

| | | | |
|---|---|---|---|
| 3,800,447 | 4/1974 | Harvey | 37/268 X |
| 4,127,951 | 12/1978 | Hatch | 37/231 |
| 4,369,590 | 1/1983 | Miller | 37/231 |
| 4,403,432 | 9/1983 | Biance | 37/268 X |
| 4,802,293 | 2/1989 | Smith | 37/268 X |
| 4,873,775 | 10/1989 | Richey | 37/231 |

*Primary Examiner*—Dennis L. Taylor
*Assistant Examiner*—J. Russell McBee

[57] ABSTRACT

Snowplow apparatus is provided having a blade assembly and elongated tongue secured at one end to the blade assembly and having a connector device at the other end for detachably securing of the tongue to a single-point hitch assembly of an automotive vehicle whereby the tongue may oscillate in a vertical plane about its point of attachment. A stabilizing mechanism secured to the tongue in axially spaced relationship to the connector device detachably connects with the vehicle to prevent oscillation of the tongue about its point of attachment to the hitch assembly of the vehicle in a horizontal plane. The blade assembly is provided with lift units automatically operable upon traversing movement of the blade assembly over a ground surface to be cleared of snow accumulation to lower the blade assembly into plowing relationship when moved in a direction effective for plowing and to lift the blade assembly a distance above the ground and support it for transport when moved in an opposite direction. The blade assembly is constructed in two elements that are pivotable about a center, vertical axis for pivoting to either a V-shape for plowing or to a position parallel to the tongue for minimizing storage space requirements.

8 Claims, 6 Drawing Sheets

SNOWPLOW APPARATUS

FIELD OF THE INVENTION

This invention relates in general to snowplow apparatus for effecting removal of accumulations of snow from surfaces such as roadways. It relates more particularly to a snowplow apparatus that is attachable to an automotive vehicle by a single point connection and automatically operable through forward and reverse movement of the apparatus over the road surface without mechanisms operated by the vehicle operator to effect raising and lowering of its ploughing blade.

BACKGROUND OF THE INVENTION

Many private roadways of a size such as the relatively long driveways of private residences in certain climatic areas receive substantial accumulations of snow. To facilitate operation of automotive vehicles over these driveways, it is necessary to remove at least a portion of such snow accumulations to avoid having vehicles become stuck on the road surface.

One type of snow removal apparatus that that become extremely popular for use on residential driveways as well as for sidewalks is the snow blower powered by a gasoline engine or electric motor. While some snow blowers are adapted to be mounted on tractors such as garden or lawnmower tractors, the most commonly used types are of a walk-behind behind type. These walk-behind snow blowers are convenient and efficient when utilized for clearing relatively small surface areas such as short drives and sidewalks. They are not particularly efficient because of the time involved to effect removal of snow from the larger surface areas of relatively long private drives as well as from other areas which may be utilized by automotive vehicles. The larger tractor mounted blowers, while better able to handle larger surface areas, are not as efficient as blade-type snow removing apparatus and, coupled with their proportionally higher cost, have not been utilized to any great extent. Also, snow blowers are generally unsafe for use on drives that are gravel paved as contrasted to the asphalt or concrete paved drives.

Larger sized snow removing apparatus having a blade is generally preferred for the relatively longer driveways and other paved areas. Blade-type apparatus has the further advantage over the blower apparatus of being able to operate on gravel paved surfaces as well as the asphalt and concrete paved areas. Blade-type apparatus of appropriate size, however, requires a fairly large vehicle to power the blade in removal of snow. To minimize the cost of blade-type snowplowing apparatus, blade-type mechanisms have been devised for attachment to automotive vehicles such as to their axles or bumpers. Blade-type apparatus heretofore devised generally includes a structural frame that is of a construction having rigidity to maintain the blade in a proper position with respect to the vehicle. The frames designed to be attached to the bumper or axle of the vehicle can be connected at either the front or the rear of a vehicle. Usually, such apparatus is designed for attachment to the rear of the vehicle as the rear bumper or associated vehicle frame members are more readily accessible. Vehicles of current design have the disadvantage of not being designed with bumpers that are of a structural nature capable of accepting and providing a suitable mount for the snowplow apparatus. Also, the axle structures have been modified substantially to the extent that it is also difficult to mount the previously known blade-type snowplow apparatus to the axle. These deficiencies in the structural configuration of previously known snowplow apparatus and techniques of attachment to automotive vehicles has lead to the devising of an improved snowplow apparatus of the structure disclosed herein and which is the subject of this invention.

SUMMARY OF THE INVENTION

The snowplow apparatus provided by this invention comprises a blade assembly secured to an end of an elongated, single-element tongue for attachment to the automotive vehicle. The end of the tongue remote to the blade assembly is of a type designed for single point connection to a mounting structure carried by the vehicle. In particular, the mounting mechanism is of the ball coupling type frequently found in use with trailers designed to be towed by such vehicles. A stabilizing mechanism in the form of cables is provided to maintain alignment of the tongue with the longitudinal axis of movement of the vehicle. This stabilizing mechanism includes a pair of cables that are coupled to the tongue at a point rearwardly of the ball joint connection with the opposite ends being secured to the vehicle such as to the bumper mounting structures in laterally spaced relationship to the ball joint connection. This arrangement and apparatus permits the snowplow apparatus to be moved in forward and rearward, reciprocating movement over driveways or other surfaces to be cleared of snow and in particular over gravel type surfaces. Snow is plowed when the vehicle is moving in a rearward direction with the bottom edge of the blade riding over the road, driveway or parking area surface. When the vehicle is caused to move in a forward direction as for repositioning to enable the blade to traverse another ground surface area, blade lift mechanisms that are provided automatically operate to elevate the blade a sufficient distance so that it will not interfere with its movement. Upon movement of the apparatus in a reverse direction as referenced to the vehicle causes automatic operation of the blade lift mechanisms to lower the blade into operative relationship to the ground surface. It will be noted that operation of the vehicle in a reverse direction is, in effect, a forward operating direction for the blade to achieve displacement of the snow.

In accordance with this invention, the blade assembly is of a dual blade construction having attachment connections selectively operable to maintain the two blade elements in either an aligned straight blade configuration or permitting the two elements to be relatively angled to each other in a V-shape. This permits the blade assembly to function in two modes as may be determined most effective in any particular situation by the operator.

Additionally, in accordance with this invention, the blade elements are hingedly mounted in a manner permitting each to be pivoted to a position substantially aligned with the tongue to minimize storage space requirements.

These and other objects of this invention will be readily apparent from the following detailed description of an illustrative embodiment thereof and the accompanying drawings.

DESCRIPTION OF THE DRAWING FIGURES

DESCRIPTION OF THE ILLUSTRATIVE EMBODIMENT

Figure 1:
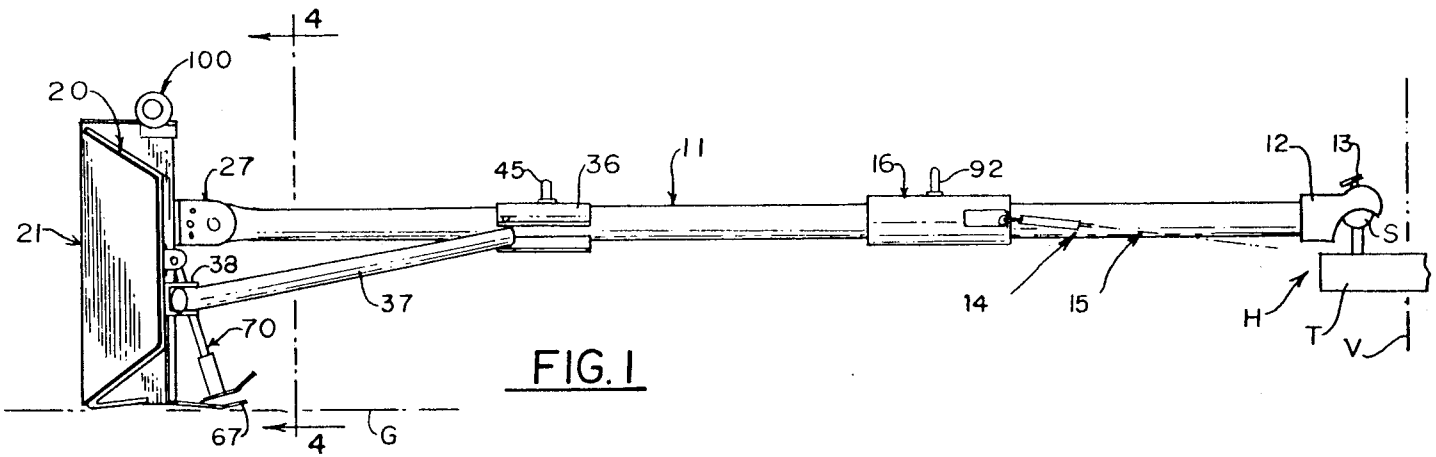
FIG. 1 is a side elevational view of a snowplow apparatus embodying this invention.

Having reference to the drawings, there is illustrated an embodiment of the snowplow apparatus of this invention. This apparatus includes a blade assembly 10 mechanically coupled with an elongated tongue 11 adapted for interconnecting the apparatus with an automotive vehicle. Attachment of the snowplow apparatus is primarily intended for the rear of an automotive vehicle and accordingly, only the rear bumper assembly of such a vehicle is diagrammatically shown in the drawings and is generally designated by the letter V. This bumper assembly includes attachment brackets indicated generally at B with a pair of such brackets provided in laterally spaced relationship such as is conventional for trailer safety chains. The automotive vehicle is also shown as being provided with a hitch assembly H. This hitch assembly H may be of the well-known type comprising an elongated tube T of square cross-section and designed to telescopically interfit in a receiving tube that is incorporated in that portion of the hitch assembly rigidly secured to other frame elements of the vehicle body. The portions of the hitch assembly other than the tube T are not shown as such are well-known in the art and do not form a part of the invention. The tube T is provided with a conventional type spherical ball connector S that is usually employed in trailer hitch assemblies for automotive vehicles.

The tongue 11 is formed from an elongated tube having a diameter of the order of two and one-half inches fabricated from metal and having a wall thickness sufficient to provide adequate structural strength to accommodate the mechanical forces that are applied to it during operation of the apparatus. These forces include not only the axially directed forces of both compression and tension, but there is a certain degree of torsional force that is also applied to the tongue. Attached to the one end of the tongue is the blade assembly 10 with the opposite end being provided with a ball connector device 12 of conventional type designed to mechanically interconnect and couple with the spherical ball connector S. This connector device includes a coupling clamp (not shown) that is operated by a hand wheel 13. Such a connector enables the operator to readily connect or disconnect this snowplow apparatus from the automotive vehicle.

A tongue stabilizing mechanism 14 is provided to maintain the elongated tongue 11 in a longitudinally aligned position with respect to the automotive vehicle during the course of operation. The illustrative tongue stabilizing mechanism 14 comprises a pair of steel cables or chains 15 that are each interconnected at one end with a connector unit 16 secured to the tongue 11 in rearwardly spaced relationship from the ball connector device 12. Structure and operation of the connector unit 16 will be further described, but at this point, it will be noted that it is provided with a pair of attachment lugs 17 disposed at diametrically opposite sides of the tongue as can be best seen in FIG. 2. Each cable 15 is secured to a respective lug 17 with the opposite ends of the cables 15 provided with connecting devices 18 adapted to facilitate detachable interconnection with of the bumper attachment brackets B. It is to be noted that bumper systems of currently produced automotive vehicles are designed to accommodate slight compressive forces for safety purposes and thus the brackets B are affixed to those portions of the vehicle's bumper assembly V, or suitable parts of the vehicle frame so as to not interfere with the normal operation of the bumper. To facilitate interconnection of the cables to the brackets, it is advantageous to provide connecting devices 18 that are easy to attach to or detach from the attachment brackets B. The connecting devices 18 are shown as being of a hook-type enabling insertion of a hook part through an aperture in the bracket with the end of the cable 15 being looped through an eye formed in the hook and secured to itself by a cable clamp 19.

In accordance with this invention, the blade assembly 10 comprises two blade elements 20 and a vertically disposed center support 21. Each of the two blade elements 20, each of which are of a length of the order of three and one-half to four feet, is pivotally secured to the center support by respective sets of hinges 22 to permit swinging of the blade elements about a vertical axis between the illustrated straight blade configuration shown in FIG. 2 and either rearwardly angled positions shown in broken lines or a position where the two blade elements are aligned in substantially parallel relationship to each other and to the tongue 11.

The center support 21 in this illustrative embodiment is of a hollow construction and structural details will be described. It will suffice at this point to note that it is of two piece construction comprising a rear section 23 and a front section 24 that are mechanically secured together. The rear section 23 includes a transversely extending backwall 25 and opposed sidewalls 26 formed at each lateral side of the backwall. The hinges 22 are secured to these sidewalls 26. Attached to the center support 21 is the tongue 11 with attachment being made to the backwall 25 by an adjustable coupling mechanism 27 that can be best seen in FIGS. 5 and 7. This coupling mechanism 27 is designed to permit relative adjustment of the angular position of the blade elements 20 about a horizontal axis and to thereby provide a degree of adjustment as to the angle at which the blade elements will operate on the accumulated snow covering of a road surface. To permit angular adjustment, the mechanism 27 includes a pair of L-shaped brackets 28 which are spaced apart a sufficient distance to receive a terminal end portion 29 of the tongue. The L-shaped brackets 28 each include a mounting leg 30 adapted to be mechanically secured to the back wall 25 of the center support. Each bracket also includes a longitudinally extending leg 31 with each such leg spaced a distance and parallel to the other and projecting a distance rearwardly from the transverse back wall 26. The terminal end portion of the tongue 29 comprises a flatened portion of the tube having a length and width dimension such that it will interfit between the spaced apart longitudinal legs 31. Each of the L-shaped brackets 28 is positioned with the longitudinally extending legs 31 oriented in vertical planes. A pivot connection between the terminal end 29 of the tongue 11 and the brackets is effected by a hinge pin 32, thereby enabling the center support 21 with the blades 20 to be pivoted about a horizontal axis and thereby change the angular position of the front face of the blades. Securing of the blades in a predetermined position is effected by an adjusting system consisting of a retainer pin 33 also adapted to extend transversely through the longitudinal legs 31 and may consist of a bolt and nut combination. Adjustability is provided by formation of a plurality of apertures 34 in each of the legs 31 in an arcuate alignment with the retainer pin 33 inserted through a selected set of such apertures. The terminal end 29 of the tongue is formed with at least one aperture (not shown) through which the pin 33 extends.

Incorporated with the blade assembly 10 is a blade angle adjustment mechanism 35 which is operable to maintain the blade elements 20 at a desired position. This adjustment mechanism 35 includes a position adjusting bracket 36 affixed to the tongue 11 in spaced relationship to the center support 21 and a pair of elongated struts 37 formed from metal tubes having a diameter of the order of two inches. One end of each of the struts 37 is pivotally interconnected with the adjusting bracket 36 with the opposite ends pivotally connected to respective ones of the blade elements 20 in relatively outward spaced relationship with respect to the center support 21. Respective hinge brackets 38 are provided for connecting with the struts 37 with each of the brackets mechanically secured to a rearwardly facing surface of a respective blade element. Each bracket 38 consists of a U-shaped structure having horizontally extending, spaced parallel plates 39 that project a distance rearwardly from the respective blade elements. A hinge pin 40 extends vertically through the bracket plates 39 and an aperture formed in the end of the respective strut 37 to enable relative pivoting movement.

Figure 2:
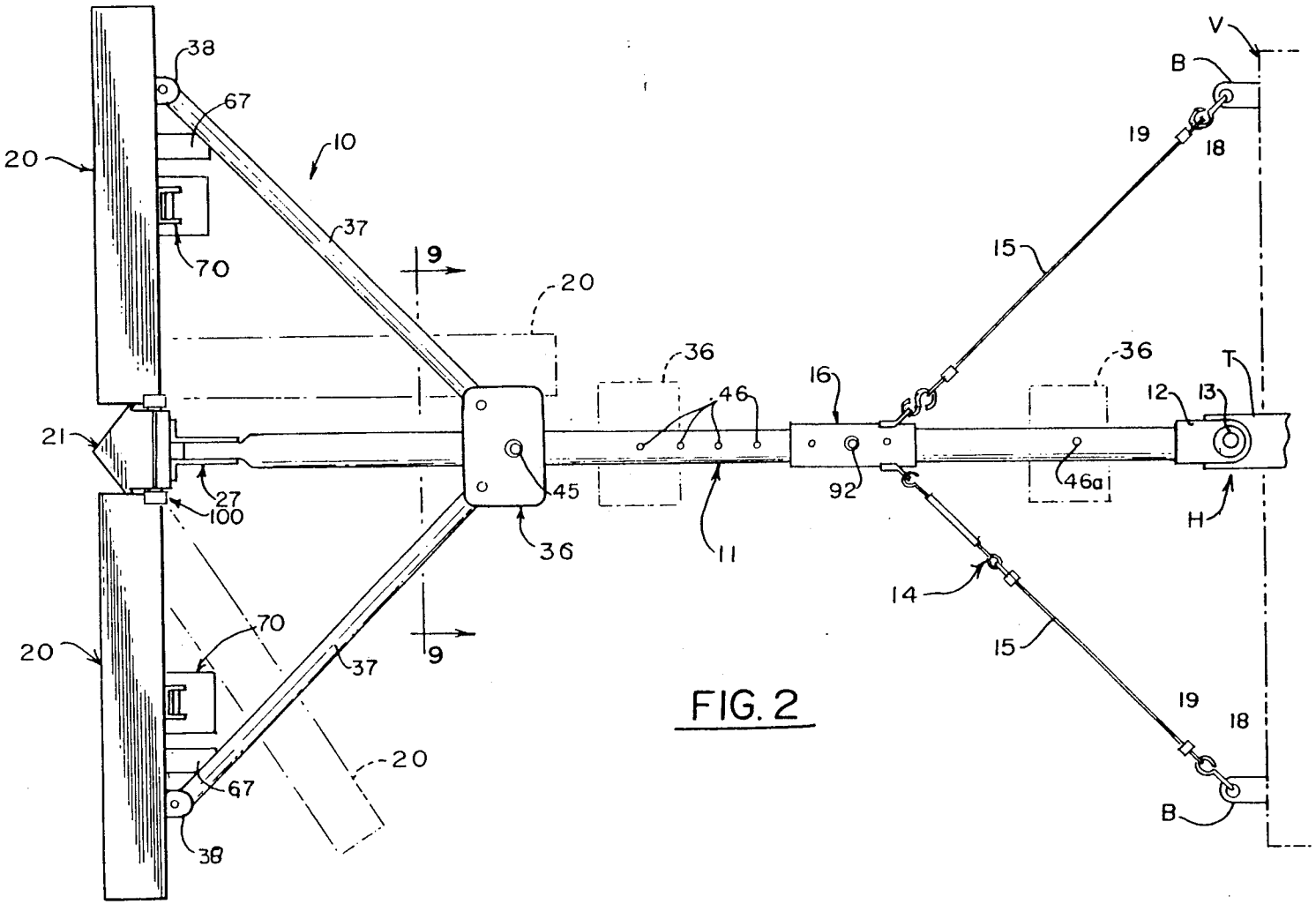
FIG. 2 is a top plan view thereof.
Figure 9:
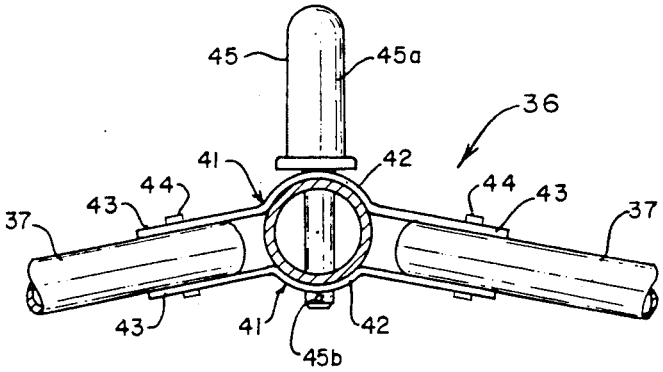
FIG. 9 is a fragmentary sectional view on an enlarged scale taken along line 9—9 of FIG. 2.

Details of construction and operation of the adjusting bracket 36 can be seen in FIGS. 1, 2 and 9. It includes a pair of plates 41 disposed in superposed relationship extend transversely across the tongue 11. Each of these plates 41 which is of a generally rectangular shape has a central portion 42 which is arcuately configured to generally conform to a portion of the outer surface of the tubular tongue 11 as can be best seen in FIG. 9. This configuration is operative to prevent the adjusting bracket from pivoting in the plane of the tongue. Each of the plates 41 include outer ends 43 that are vertically spaced apart a distance to receive the ends of the struts 37. Interconnection of the struts to the plates is effected by respective hinge bolts 44 extending vertically through the bracket 36 and the struts 37. It will be noted by reference to FIG. 2 that the struts 37 are secured to the blade elements 20 by the hinge brackets 38 at a vertical elevation which is below the point of interconnection of the tongue 11 with the center support 21. This results in the struts 37 being displaced at a slight angle with respect to the tongue with the hinge brackets 38 and adjusting bracket 36 being configured and dimensioned to accommodate this angled disposition. Longitudinal adjustment of the bracket 36 along the tongue 11 effects the angular positioning of the blade elements 20 as the bracket 36 is longitudinally slideable along the tongue. Securing of the bracket at a desired location is effected by a positioning pin 45. A number of apertures 46 of a size to receive the pin are formed in the tongue along its longitudinal axis with the apertures being spaced a distance apart as can be seen in FIG. 2. The pin 45 is advantageously formed with a handgrip **45*a* at its upper end and is provided with a detent-type latch 45*b* at its lower end to prevent inadvertent dislodgement. Appropriate alignment of the brackets 36 relative to those apertures permits insertion of the pin 45 through an aperture formed in the bracket and a selected one of the tongue apertures 46. As can be readily seen in FIG. 2, this permits the adjusting bracket 36 to be located so as to position the blade elements 20 in either the straight transverse position or any one of several angular positions as well as a position substantially parallel to the tongue 11. Additional selection in the positioning can be effected by forming a plurality of apertures 47 in the bracket plates 41 in longitudinally spaced alignment. Two such additional apertures 47 are shown in the illustrative embodiment. It will be understood that the two blade elements 20** will be concurrently placed in the same relative positions through positioning of the adjusting bracket at a selected location.

Figure 7:
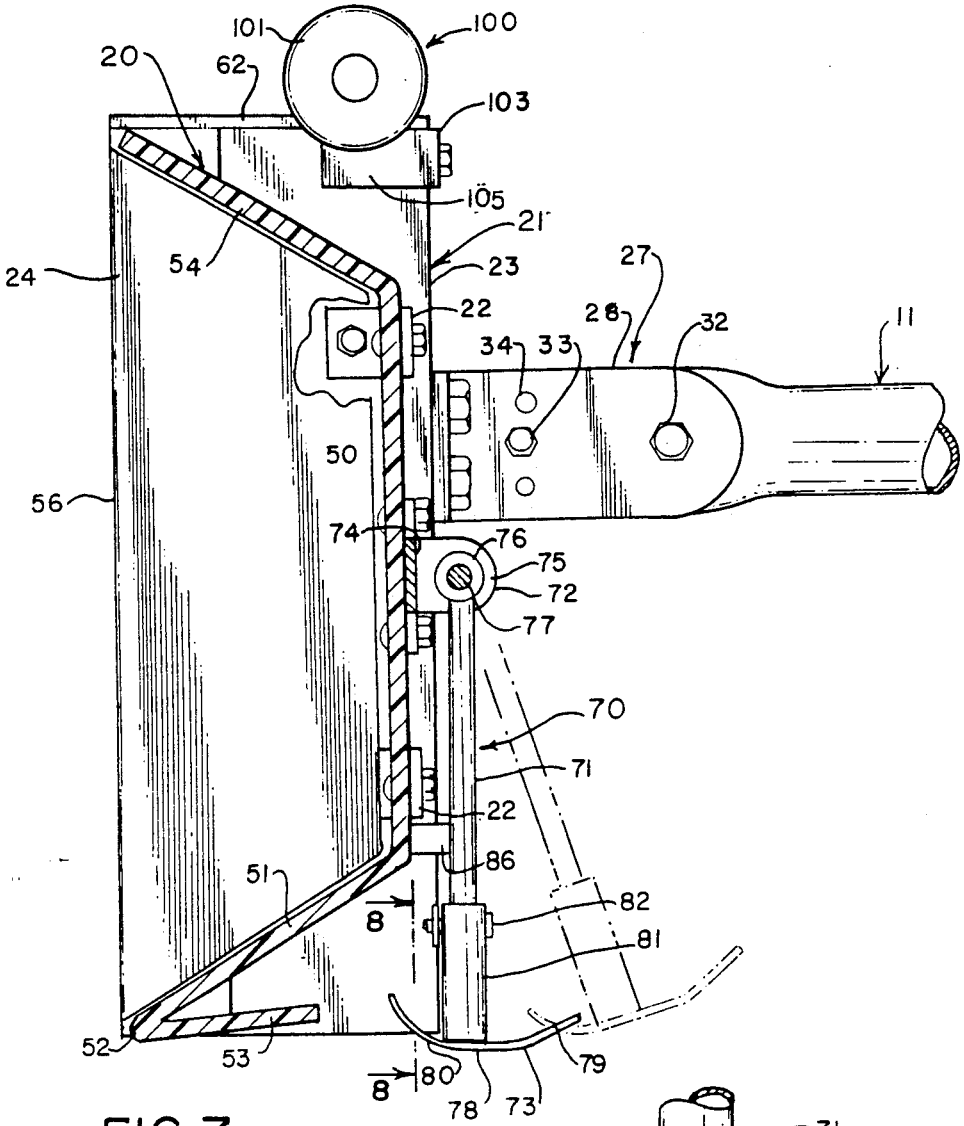
FIG. 7 is a fragmentary sectional view on an enlarged scale taken along line 7—7 of FIG. 4.

In this illustrative embodiment of the invention, each of the blade elements 20 is shown, as can be best seen in FIGS. 1 and 7, as being formed with an elongated center panel 50 that is vertically disposed and is secured at its one end to the hinges 22 attached to the center support 21. A lift plate 51 is provided at the bottom edge of the center panel and extends in downwardly and forwardly inclined relationship thereto terminating in a leading edge 52 that is adapted traverse the ground surface in closely spaced relationship to be cleared of snow. Movement of the snow is facilitated by this lift plate 51 as it elevates the snow which, upon engaging the center panel, will tend to be rolled in the direction of plowing, thereby making it easier to displace the snow with the blade elements diposed in either a straight or angled relationship. Carried by the lift plate 51 is a shoe plate 53 which is joined therewith at its leading edge 52 and extends a distance rearwardly therefrom in a substantially horizontal plane. When the blade assembly 10 is positioned in operative relationship to the ground surface to be cleared of snow, the shoe plate 53 engages that surface, thus supporting the blade elements for sliding movement over the ground surface and prevents the blade elements from digging into the ground. A control plate 54 is provided at the top of the center panel 50 in parallel relationship thereto and projecting in an upwardly and forwardly inclined relative position. Where large accumulations of snow are being removed, this control plate tends to enhance the rolling effect and also prevent snow from flowing over the top of the blade elements. The vertical height of the blade elements 20 is determined by the depth of snow accumulations expected to be removed by the snowplow apparatus and may be in the range of one and one-half to two feet. While the blade elements 20 are shown as being integrally formed structures such as by molding or extruding of suitable plastic material, it will be understood that the several components of the blade elements may be individually fabricated and assembled and that these elements may be fabricated from materials other than plastic.

Figure 5:
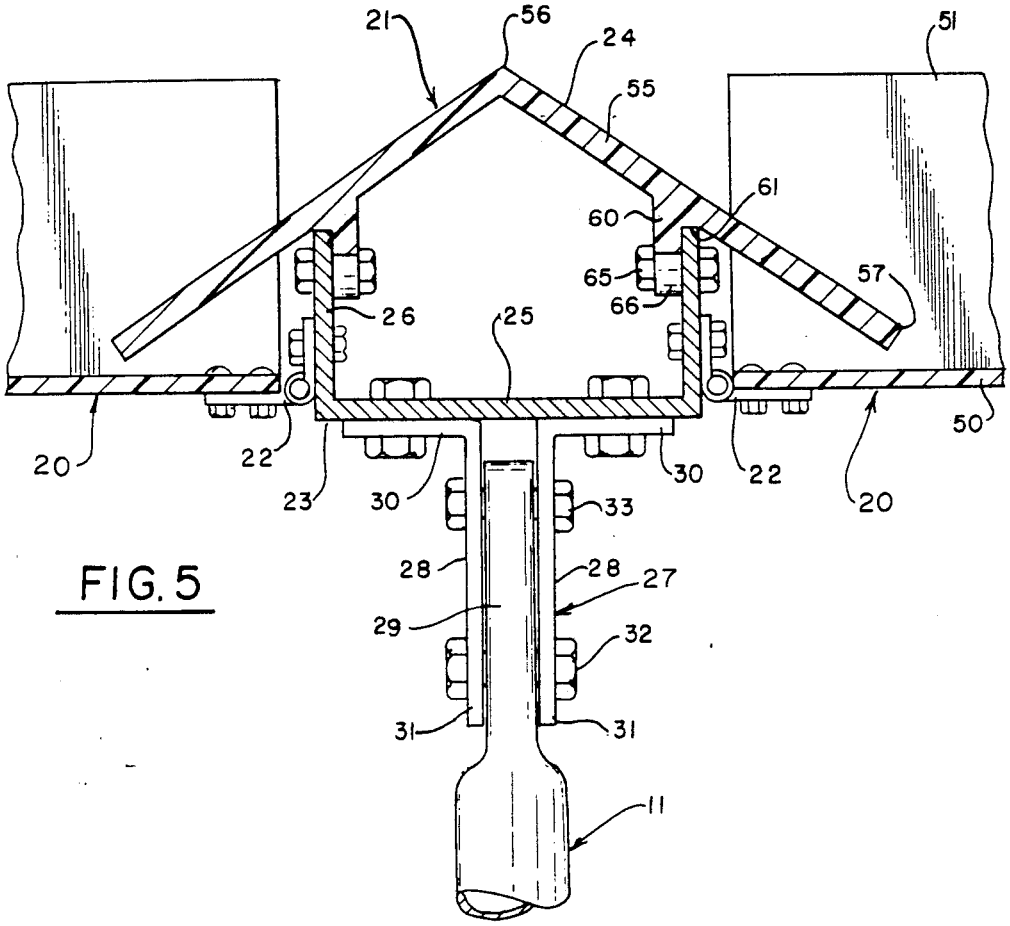
FIG. 5 is a fragmentary sectional view on an enlarged scale taken along line 5—5 of FIG. 4.

In addition to serving as means for connecting the blade assembly 10 to the tongue 11, the center support 21 functions to complete the face of the blade assembly by forming an interconnection between the two blade elements 20 at their centrally located, adjacent ends. This interconnection is effected by the front section 24 which, as can be best seen in FIGS. 2 and 5, is of V-shaped configuration when viewed on a horizontal plane having respective vertically disposed walls 55 which converge in a forward direction at a center line 56. Each of the walls 55 extends a distance laterally to project over marginal end portions of a respective blade element 20 with the vertical edges 57 of the walls tapered at both the upper and lower ends to form angled edges 58 and 59. These angled edges are configured to accommodate the inclined surfaces of the lift plate 51 and the control plate 54 when the blade elements 20 are placed in a straight aligned position. While the illustrated front section 24 is of a straight line and flat surface configuration, the front face may be otherwise configured. For example, the front facing surfaces may be concave configured to more closely approximate the concave front face of the blade elements.

The illustrated embodiment of the center support 21 has rear and front sections 23 and 24 that are mechanically interconnected. The rear section is shown as being fabricated from a section of metal channel of a length substantially equal to the vertical height of the blade elements 20 and is open at both ends. It is formed with a wall thickness that provides sufficient structural strength to accommodate the expected torsional or bending forces that may be encountered during the course of normal use of the apparatus and having a width of the order of eight inches. The back wall 25 and sidewalls 26 provide a structurally rigid mounting base for attachment of the brackets 28 for coupling with the tongue and the hinges 22 that carry the blade elements 20. The front section 24 is shown as being fabricated from a suitable plastic material such as by a molding technique. It is formed with a pair of flanges 60 that project from the rear face of the walls 55 and are each positioned to extend along the inner face of a respective one of sidewalls 26 of the rear section 23 and maintain the front section against lateral displacement. Extending between each flange 60 and the outer component of the respective walls 55 is a seating surface 61 which bears against the edge of the rear section's sidewalls 26 for carrying of the longitudinally directed forces developed as a consequence of plowing operations. A cap plate 62 is integrally formed with the walls 55 at their upper ends and extends rearwardly in overlying relationship to the rear section 23 and is configured to close the top. Mechanical securing of the front section 24 to the rear section 23 at the upper end of the center support is effected by a locking lug 63 integrally molded with the cap plate 62 on its under surface along each longitudinal side at a position to interfit in a mating recess 64 formed in each of the sidewalls 26. Mechanical securing of the two sections is completed by a fastening device such as a bolt and nut assembly 65 extending through the sidewall 26 and a flange extension 66 formed with each flange 60 at its lower end. This construction enables the several components to be readily attached to the rear section 23 and the front section 24 to be easily secured by the locking lugs 63 and recesses 64 and the bolt and nut assembly through the open bottom. While this two section construction of the center support 21 has certain advantages, it is to be noted that it may be otherwise constructed such as by molding from suitable plastic material as a single unitary element.

Figure 13:
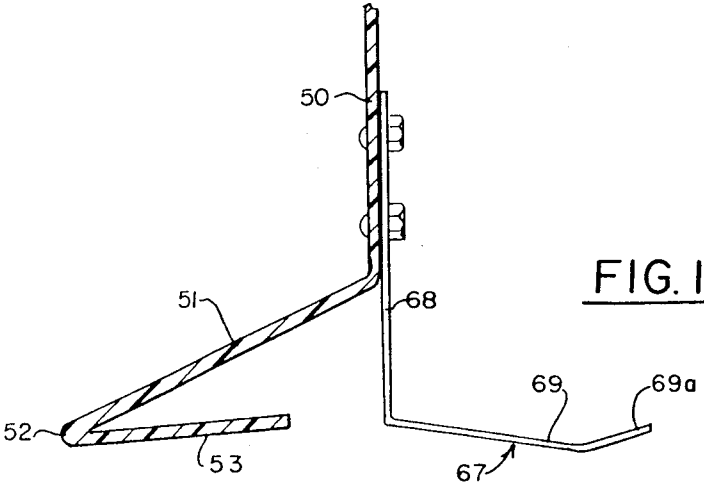
FIG. 13 is a fragmentary sectional view taken along line 13—13 of FIG. 4 showing the glide pads.
Figure 4:
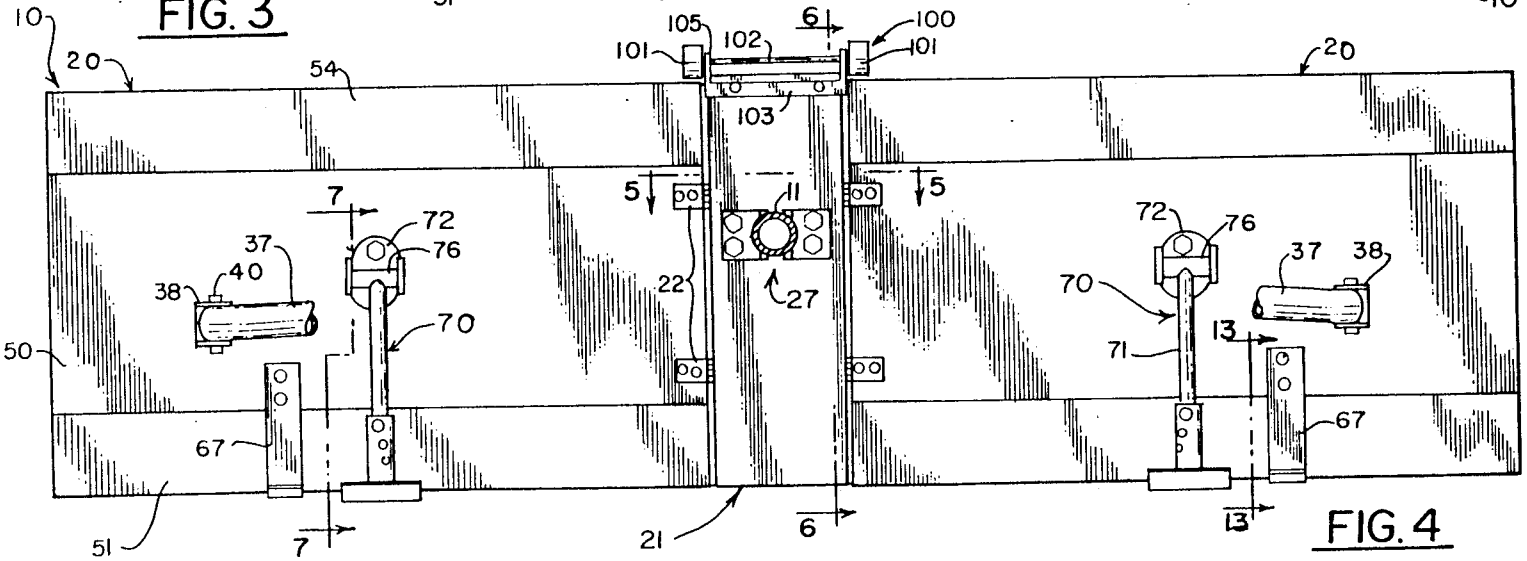
FIG. 4 is an elevational view of the rear of the blade assembly as seen along line 4—4 of FIG. 1.

It is advantageous to provide the blade assembly with glide pads 67 to enhance its ability to traverse uneven surfaces such as may be encountered in the case of gravel paved roads or driveway surfaces. Two glide pads are provided with one pad being secured to each blade element at about its midpoint as can be seen in FIGS. 2 and 4 with their structural configuration shown in greater detail in FIG. 13. Each glide pad 67 is formed from an elongated strip of flat metal plate in a generally L-shaped configuration and having a vertically extending mounting leg 68 adapted to be bolted to the rear of the center panel 50 of a respective blade element 20. The mounting leg 68 extends downwardly to a point slightly above a horizontal plane defined by the shoe plate 53 of the blade element where it joins with a generally horizontally disposed glide plate 69 which extends a distance rearwardly from the blade element and terminates in an upturned lip **69*a* which facilitates initial reverse movement of the blade assembly. It is advantageous to have the glide plate angled slightly downward such as at an angle of the order of five (5) degrees to the horizontal plane or ground surface G. The glide plates in the illustrative embodiment are about three (3) inches wide and eight (8) inches in length. The general function of the glide pads is that during the course of a plowing operation, they slide over the ground surface and aid in supporting of the blade assembly for movement in cooperation with the blade element's shoe plates 53**. If the shoe plates should encounter a depression in the ground surface, the glide pads will support the blade assembly to maintain it in a relatively stable plane of movement paralleling the general plane of the ground surface G.

Figure 3:
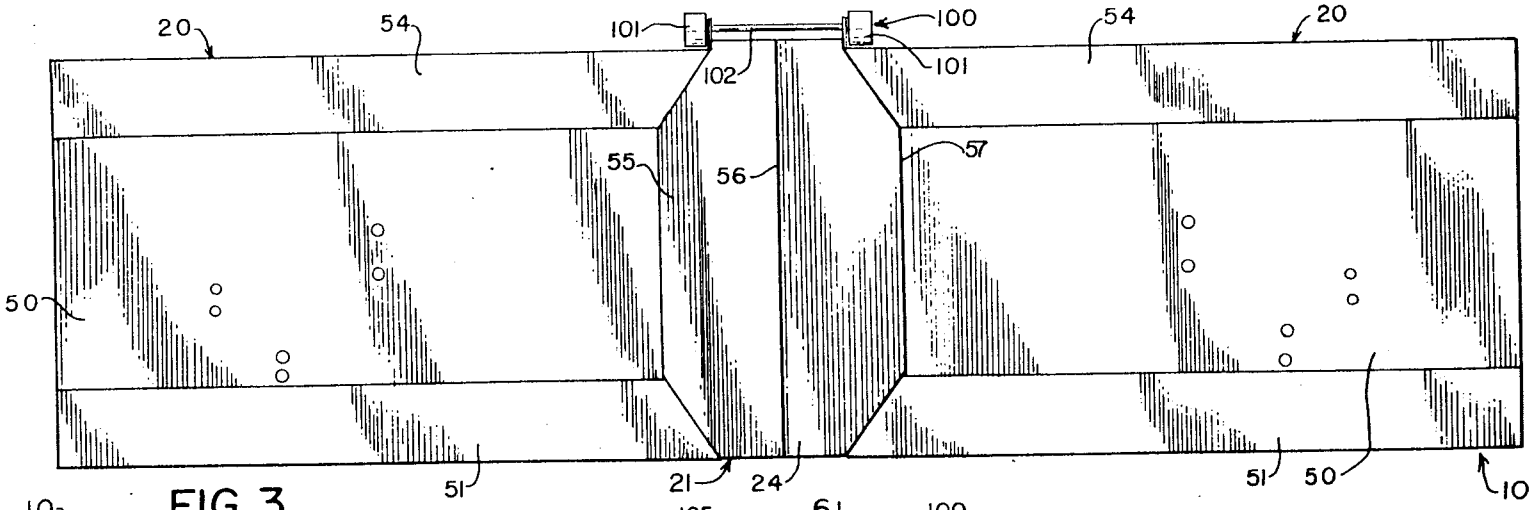
FIG. 3 is a front elevational view of the blade assembly.
Figure 8:
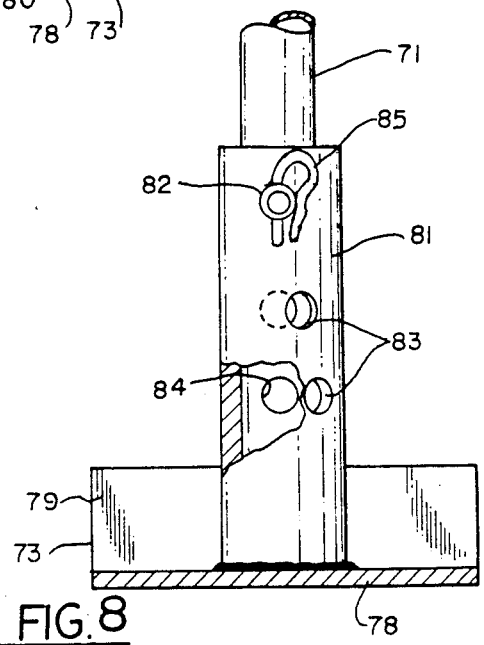
FIG. 8 is a fragmentary sectional view on an enlarged scale taken along line 8—8 of FIG. 7.

For reverse movement of the apparatus such as in repositioning for subsequent plowing movement, it is particularly advantageous to lift and maintain the blade assembly 10 in an elevated position above the ground surface. This is desirable to prevent the shoe plate 53 from digging into the ground surface, thereby avoiding unnecessary wear as well as facilitating movement. To achieve this objective an automatically operable lift mechanism is provided which functions without operator control input to elevate the blade assembly 10 upon initial displacement of the blade assembly in a reverse direction and to then lower the blade assembly upon initial movement in a forward or plowing direction. This lift mechanism consists of two similar lift units 70 with one being carried by or affixed to each of the blade elements 20 as shown in FIGS. 1, 2 and 3 with further constructional details shown in FIGS. 7 and 8. These lift units 70 are shown in full lines in these drawing figures as being in a position operative to effect lifting of the blade assembly 10 a short distance above the ground surface G diagrammatically represented by a broken line. The distance of elevation is determined in part by the type of ground surface on which the snow plow apparatus will be used so as to provide sufficient clearance. Greater clearance is desired in the case of surfaces paved with gravel than concrete or asphalt paved surfaces, but a lift in the range of one-half to one inch.

Each lift unit 70 is attached to a respective blade element 20 at approximately a midpoint laterally of element, thus providing substantially balanced support. The units comprise a vertically disposed, elongated strut 71 pivotably attached at its upper end of the blade element by a hinge bracket 72 and provides a ground engaging skid 73 at its lower end. The hinge bracket includes a base plate 74 adapted to be bottled to the center panel 50 of the blade element and provided with a pair of rearwardly projecting lugs 75 spaced a distance apart horizontally. Secured to the upper end of the tubular strut 71 is a hinge tube 76 extending between the lugs 75 and mounted on an axle 77 having its ends fixed in the lugs. The hinge tube and axle are of a length and diameter sufficient to accommodate torsional forces that may be applied as a consequence of the skid 73 sliding over the ground surface. The skid 73 comprises a metal plate having a center section 78 adapted to engage the ground surface and upwardly inclined lead section 79 which facilitates movement of the skid over the ground surface, particularly one paved with gravel. A trailing section 80 is formed at the opposite end of the center section 78 and has an upwardly curved configuration which prevents the skid from digging into the ground surface when the apparatus is moved over the ground surface as in a plowing operation.

Attachment of the skid 73 to the strut 71 is effected by a short cylindrical tube 81 secured at one of its ends to the upper surface of the skid's center section 78 as by welding and which telescopically receives an end portion of the strut. Mechanical securing of the tube and strut is effected by a pin 82 adapted to project through sets of aligned holes 83 and 84 formed in the tube and in the strut 71, respectively. A spring retainer clip 85 is provided to engage with the pin 82 to retain the pin in an aligned set of holes, but which is readily removable to permit adjustment of the angular position of the skid with respect to the blade element as well as the extent of vertical elevation. In this illustrative embodiment, the strut 71 is provided with three holes 84 that are disposed in axially spaced alignment. Three holes 83 are provided in the tube 81 and in axially spaced relationship, but they are also angularly spaced apart by angles such as 15 and 30 degrees. The purpose of the angular spacing is to permit the skid 73 to be more nearly aligned with its line of travel when the blade elements are placed in different angled positions. It is not necessary that the skid be precisely aligned with direction of movement and even though the tongue 11 may be provided a larger member aperture 46 for position of the blade elements in other than 15 and 30 degree positions, three angularly spaced holes 83 are deemed sufficient. Vertical adjustment of the distance of the blade above the ground surface can be effected as by aligning a selected hole 83 in the tube 81 with a selected one of the holes 84 in the strut 71.

Operation of the lift units 70 will be readily apparent by reference to FIG. 7. With the lift units supporting the blade assembly in an elevated position, movement of the blade assembly to the left will result in pivoting of the struts 71 to the broken line position and effect automatic lowering of the blade assembly. Continued movement of the blade assembly to the left as seen in FIG. 7 will merely result in the skids 73 following with their trailing sections 80 sliding over the ground surface. When it is desired to move the blade assembly 10 to the right when viewed in FIG. 7, the lift units 70 will automatically operate to elevate the blade assembly. During initial movement to the right, the skids 73 will remain at one position and the struts 71 will relatively pivot as toward a respective blade element, thereby causing vertical elevation of the blade assembly. A stop block 86 may be applied to the rear face of the blade element's center panel 50 to prevent movement of the strut beyond a center position.

Figure 12:
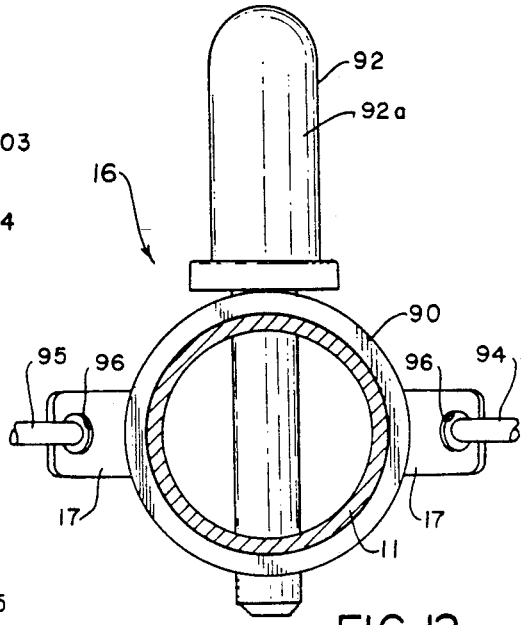
FIG. 12 is a sectional view on an enlarged scale taken along line 12—12 of FIG. 10.
Figure 10:
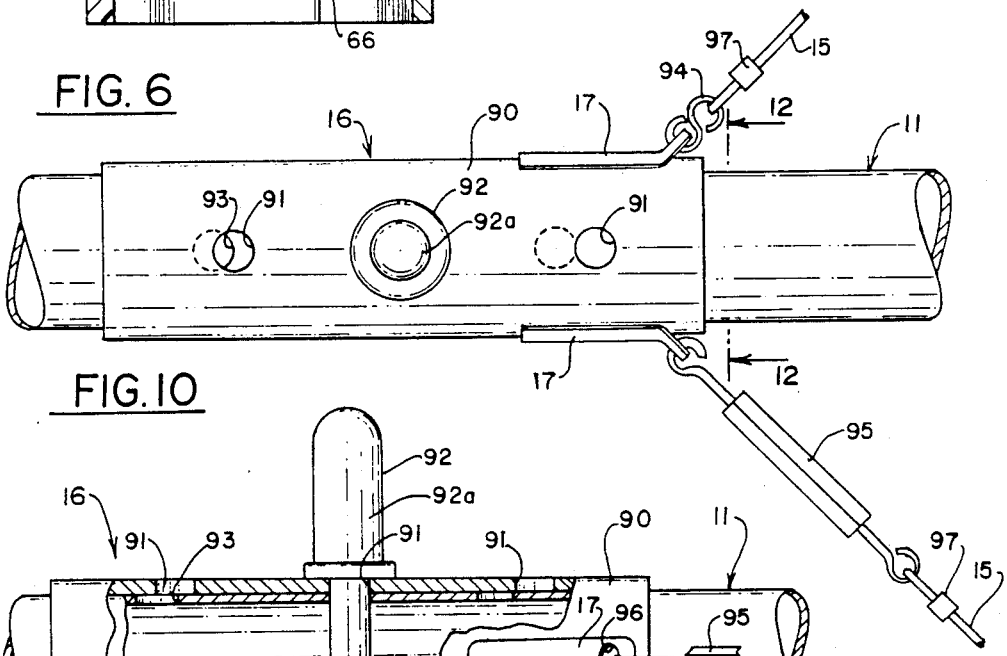
FIG. 10 is a fragmentary top plan view showing the connector unit of the tongue stabilizing mechanism and associated portions of the elongated tongue.
Figure 11:
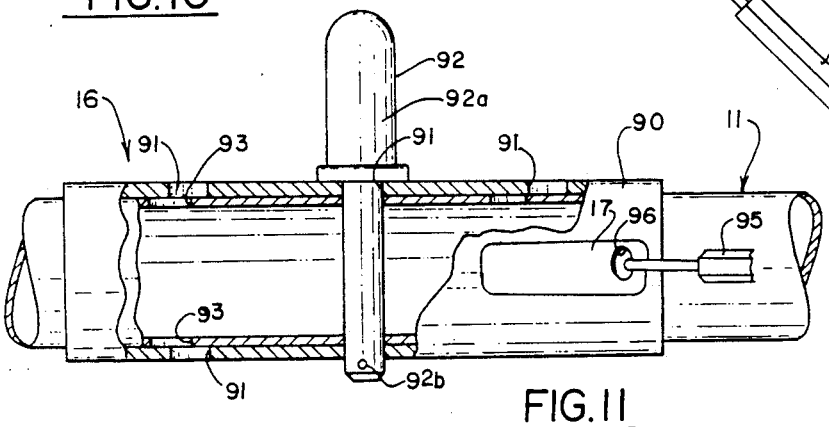
FIG. 11 is a side elevational view of the connector unit and associated portions of the elongated tongue.

As previously noted, the tongue stabilizing mechanism 14 included a connector unit 16 designed for securing the stabilizing cables 15 tautly between the vehicle and the elongated tongue 11. The objective is to substantially prevent lateral swinging movement of the tongue 11 and thus permit utilization of the single-point, ball joint connection of the tongue with the vehicle. Structural details of the illustrative embodiment of the connector unit can be best seen in FIGS. 10, 11 and 12 and which comprises a tubular sleeve 90 telescopically mounted on the tongue 11 for relative axial displacement. A plurality of sets of holes 91 in spaced apart, axial alignment are formed in the sleeve at the top and bottom in diametrically opposed relationship and of a size to receive a retainer pin 92. This retainer pin is formed with a hand grip **92*a* at the top and is provided with a detent-type latch 92*b* at its lower end to prevent inadvertent removal. A plurality of holes 93 are also formed in the tongue 11 in axially spaced alignment at the top and bottom in diametrically opposed relationship to cooperatively align with respective ones of the holes 91 in the sleeve 90. It will be seen in FIG. 11 that the series of holes 91 in the sleeve 90 are not spaced equidistantly with respect to the spacing of the holes 93 in the tongue. With the center holes 91, 93 aligned, the holes to the left of center are offset by a distance of one-half their diameter while the sets of holes to the right are offset by a full diameter. This offset arrangement of the holes enables the connector unit 16 to be displaced in relatively small increments and thereby better effect maintaining of the cables in relatively taut relationship. It is difficult to secure the cable in the desired taut manner and temperature differences affect the cable's length, but this connector unit is capable of enabling the operator to readily set the sleeve 90 on the tongue at a position for maintaining of the tongue in a longitudinally aligned position with respect to the vehicle. It will be understood that the number of holes 93 in the tongue 11 and the number of holes 91** in the connector unit sleeve may be increased to obtain greater extent of adjustment giving due consideration to maintaining the structural integrity of the tongue.

In this illustrative embodiment of this invention, the ends of the cables 15 are secured to the respective attachment lugs 17 of the sleeve 90 of the connector unit 16 by means which further facilitates placing the cables in taut relationship. One of the cables has an end connectable to a respective lug by an S-hook 94 while the other cable is connected to its lug by a turnbuckle 95. The S-hook and turnbuckle each have hook elements that couple with the lugs through respective apertures 96. The cables have end portions looped through or around elements of the turnbuckle and S-hook and secured to the cable by cable clamps 97. With the sleeve 90 secured at a selected position on the tongue, the turnbuckle 95 can be operated as necessary to eliminate any remaining slack and obtain the desired tautness. It will be noted that another turnbuckle may be substituted for the S-hook 94 if a greater degree of adjustability is desired.

The illustrated embodiment of the snowplow apparatus of this invention is constructed to enable the blade elements 20 to be swung to a position substantially parallel to the tongue 11 as shown in FIG. 2 for compactness to minimize storage space requirements. To permit swinging of the blade elements to this position, the connector unit 16 is released to enable it to move axially and permit the bracket 36 of the blade angle adjustment mechanism 35 to move to the position shown in broken lines in FIG. 2. An aperture 46*a* is provided in a forward portion of the tongue whereby the bracket 36 may be secured to maintain the blade elements in the folded storage position.

Figure 6:
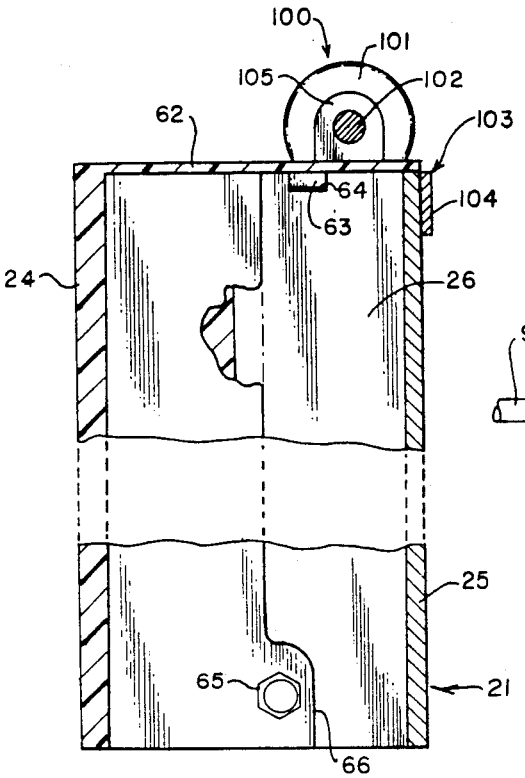
FIG. 6 is a sectional view on an enlarged scale taken along line 6—6 of FIG. 4.

To facilitate movement of the apparatus when disconnected from a vehicle such as to or from storage, or to effect connection with a vehicle, the apparatus is provided with a wheel set 100. This wheel set which can be seen in FIGS. 1, 2, 3 and 4 is shown in greater structural detail in FIGS. 6 and 7 and is attached to the upper end of the center support 21 where it does not interfere with the plowing operations of the apparatus. The wheel set includes a pair of wheels 101 journalled on an axle 102 carried by a mounting bracket 103. This bracket 103 includes a transverse bar 104 which is secured to the back wall 25 of the rear section 23 of the center support 21 and an axle support leg 105 at each end of the bar. The axle support legs 105 project a distance above the top end of the center support 21 and toward the front of the blade assembly. 10. When the blade elements 20 are in the stored configuration parallel to the tongue 11 and the apparatus is separated from the vehicle, the apparatus is inverted from the orientation shown in FIG. 1 to place the wheels 101 on the ground surface. It is relatively easy then for the apparatus to be maneuvered manually by holding the tongue 11 adjacent the end with the ball connector device 12. Lateral stability of the apparatus is enhanced by forming the transverse bar 104 of a length greater than the width of the center support 21.

It will be readily apparent that a novel and improved snowplow apparatus is provided by this invention. This apparatus having a single point attachment to the automotive vehicle enables it to be readily connected thereto and operated by such a vehicle without other mechanical controls to effect its operation. The blade assembly is of a construction that provides enhanced operation in effecting plowing or displacement of accumulations of snow.

Having thus described this invention, what is claimed is:

1. A snowplow apparatus adapted to be attached to and driven by an automotive vehicle having a single-point hitch assembly comprising 1) a blade assembly adapted for traversing movement over a ground surface having blade means including an upright, elongated plowing face for effecting displacement of snow accumulated on the ground surface over which said blade assembly is caused to traverse;

2) an elongated tongue having a first end secured to said blade assembly and extending in substantially orthogonal relationship to said plowing face at a side opposite thereto and a second end provided with connector means adapted to mechanically couple with the vehicle hitch assembly to permit angular displacement of said tongue in both vertical and horizontal planes about the point of interconnection of said connector means and the hitch assembly with respect to a horizontal plane, said tongue operative to effect displacement of said blade assembly in either direction with respect to said tongue's longitudinal axis; and 3) tongue stabilizing means mechanically coupled with said tongue and adapted to be mechanically coupled with the vehicle to which the tongue may be coupled and operative to substantially prevent said tongue from oscillating about the point of interconnection of said connector means and the hitch assembly in a horizontal plane.

2. A snowplow apparatus according to claim 1 wherein said tongue stabilizing means includes bracing means mechanically coupled with said tongue at a point axially spaced a distance from said hitch assembly connector means and adapted to be secured to the automotive vehicle in laterally spaced relationship to the vehicle's hitch assembly for maintaining said tongue in substantially longitudinally aligned relationship to the vehicle when connected thereto and permitting oscillation of said tongue in a vertical plane about its point of interconnection with the vehicle's hitch assembly.

3. A snowplow apparatus according to claim 2 wherein said bracing means includes two elongated tension members having respective first ends connected to said tongue and respective second ends adapted to be secured to the automotive vehicle, said tension members being disposed to extend in relatively outwardly divergent relationship from opposite sides of said tongue in a common substantially horizontal plane.

4. A snowplow apparatus according to claim 3 wherein each of said tension members is a flexible member.

5. A snowplow apparatus according to claim 3 wherein each of said tension members is a flexible cable.

6. A snowplow apparatus according to claim 2 wherein said tongue stabilizing means includes a connector unit for enabling coupling of said bracing means with said tongue at a selected one of a plurality of axially displaced positions.

7. A snowplow apparatus according to claim 6 wherein said connector unit includes a connecting element selectively positionable axially of said tongue and securing means for fixing of said connecting element at a selected one of said axially displaced positions.

8. A snowplow apparatus according to claim 6 wherein said connector unit includes an elongated tubular sleeve disposed on said tongue and axially movable therealong, at least one of said tongue and said sleeve having a plurality of axially spaced apertures and the other having at least one aperture whereby pairs of apertures may be placed in alignment, and a retainer pin adapted to be positioned in a pair of aligned apertures to fix said sleeve on said tongue at a selected position.

* * * * *